US008363877B2

(12) United States Patent
Morisawa

(10) Patent No.: US 8,363,877 B2
(45) Date of Patent: Jan. 29, 2013

(54) HEADPHONES AND EARMUFFS

(75) Inventor: Rui Morisawa, Tokyo (JP)

(73) Assignee: Sony Corporation, Tokyo (JP)

( * ) Notice: Subject to any disclaimer, the term of this patent is extended or adjusted under 35 U.S.C. 154(b) by 586 days.

(21) Appl. No.: 12/686,571

(22) Filed: Jan. 13, 2010

(65) Prior Publication Data

US 2010/0177907 A1 Jul. 15, 2010

(30) Foreign Application Priority Data

Jan. 14, 2009 (JP) ..... 2009-006097

(51) Int. Cl.

| | |
|---|---|
| ***H04R 25/00*** | (2006.01) |
| ***H04R 1/10*** | (2006.01) |
| ***A42B 1/06*** | (2006.01) |
| ***A42B 1/08*** | (2006.01) |

(52) U.S. Cl. ..... 381/383; 381/74; 381/370; 381/374; 381/376; 2/209; 2/423

(58) Field of Classification Search ..... 381/74, 381/383, 376–379, 374, 370; 2/423, 209; 181/129, 374; 379/430
See application file for complete search history.

(56) References Cited

U.S. PATENT DOCUMENTS 7,720,246 B2 * 5/2010 Wang et al. ..... 381/383

FOREIGN PATENT DOCUMENTS

| | | |
|---|---|---|
| JP | 60-064691 U | 5/1985 |
| JP | 10-191490 | 7/1998 |

OTHER PUBLICATIONS

Japanese Office Action issued Apr. 3, 2012 in connection with Japanese Application No. 2009-006097.

* cited by examiner

*Primary Examiner* — Vivian Chin
*Assistant Examiner* — Douglas Suthers
(74) *Attorney, Agent, or Firm* — Wolf, Greenfield & Sacks, P.C.

(57) ABSTRACT

There is provided a headphone comprising: a pair of right and left housings each for accommodating a speaker unit; a headband having a shape curved in a longitudinal direction to which the pair of right and left housings are connected on both sides in the longitudinal direction, respectively; and first to third hinges provided on the headband so as to be arranged in the longitudinal direction and capable of folding the headband in an inner side direction of curvature; wherein the first hinge positioned between the second and third hinges is capable of folding the headband about a hinge axis tilted relative to a forward and backward direction perpendicular to the longitudinal direction of the headband such that both ends in the longitudinal direction of the headband folded only by the first hinge do not contact each other.

9 Claims, 14 Drawing Sheets

HEADPHONES AND EARMUFFS

BACKGROUND OF THE INVENTION

1. Field of the Invention

The present invention relates to headphones and earmuffs.

2. Description of the Related Art

Recently, a player of various sounds or videos and the like is developed, and the player is often carried out to play. In such player, it is not sufficient that only portability thereof is excellent, and a demand for a sound quality and the like by a user also becomes high.

When playing the sound while ensuring the sound quality, the headphones are often used. Although there are various types of headphones, the portability of the headphones is extremely important when used with the above-described player having the excellent portability.

Then, as disclosed in the Japanese Patent Application Laid-Open No. 10-191490 and the like, for example, the headphones capable of being folded are developed. The headphones disclosed in the Japanese Patent Application Laid-Open No. 10-191490 folds the headband at three points to make a volume of the headphones at the time of carrying and the like small, thereby improving the portability thereof.

SUMMARY OF THE INVENTION

However, although the headphones disclosed in the Japanese Patent Application Laid-Open No. 10-191490 may improve the portability thereof to a certain degree, when being applied to the headphones having the larger housings, for example, the portability is not sufficient. Also, since the headband might be damaged when pieces of the folded headband contact (or interfere with) each other, it is desired to improve the durability at the time of carrying. Meanwhile, it is also desired for the earmuffs having the shape similar to that of the headphones to improve the portability and the durability.

In light of the foregoing, it is desirable to provide novel and improved headphones and earmuffs capable of improving the durability thereof at the time of carrying while further improving the portability thereof.

According to an embodiment of the present invention, there is provided a headphone including a pair of right and left housings each for accommodating a speaker unit, a headband having a shape curved in a longitudinal direction to which the pair of right and left housings are connected on both sides in the longitudinal direction, respectively, and first to third hinges provided on the headband so as to be arranged in the longitudinal direction and capable of folding the headband in an inner side direction of curvature, wherein the first hinge positioned between the second and third hinges is capable of folding the headband about a hinge axis tilted relative to a forward and backward direction perpendicular to the longitudinal direction of the headband such that both ends in the longitudinal direction of the headband folded only by the first hinge do not contact each other.

The second and third hinges may be capable of folding the headband about the hinge axes extending in the forward and backward direction.

The first hinge may be arranged on a substantially center position of the headband in the longitudinal direction, and the second and third hinges may be arranged on positions closer to the first hinge than to the housings with the first hinge interposed therebetween in the longitudinal direction of the headband.

The positions of the second and third hinges on the headband may be set such that the first hinge is positioned in the vicinity of the housing when the headband is folded by the first to third hinges.

The headband may be formed of a material having flexibility twistable at least about the longitudinal direction, such that the housings do not contact each other when the first hinge folds the headband.

The expanding and contracting portion capable of expanding and contracting the headband in the longitudinal direction may be provided on at least one spot of the headband, and the expanding and contracting portion may expand and contract the headband such that the housings do not contact each other when the first hinge folds the headband.

The housings may be connected to the headband so as to be tiltable such that planes from which the speaker unit generating a sound oppose to each other when the headband is folded by the first to third hinges.

The headphone further may include a signal line arranged in the headband for transmitting a sound signal between driving circuits accommodated in both of the housing, wherein the signal line is arranged so as to intersect with the hinge axis of the first hinge at right angles.

According to another embodiment of the present invention, there is provided an earmuff including a pair of right and left earmuff portions for covering ears of a wearer at the time of wearing, a headband having a shape curved in a longitudinal direction to which the pair of right and left earmuff portions are connected on both sides in the longitudinal direction, respectively, and first to third hinges provided on the headband so as to be arranged in the longitudinal direction and capable of folding the headband in an inner side direction of curvature, wherein the first hinge positioned between the second and third hinges is capable of folding the headband about a hinge axis tilted relative to a forward and backward direction perpendicular to the longitudinal direction of the headband such that both ends in the longitudinal direction of the headband folded only by the first hinge do not contact each other.

As described above, according to an embodiment of the present invention, it is possible to improve the durability thereof at the time of carrying while improving the portability thereof.

DETAILED DESCRIPTION OF THE EMBODIMENTS

Figure 1A:
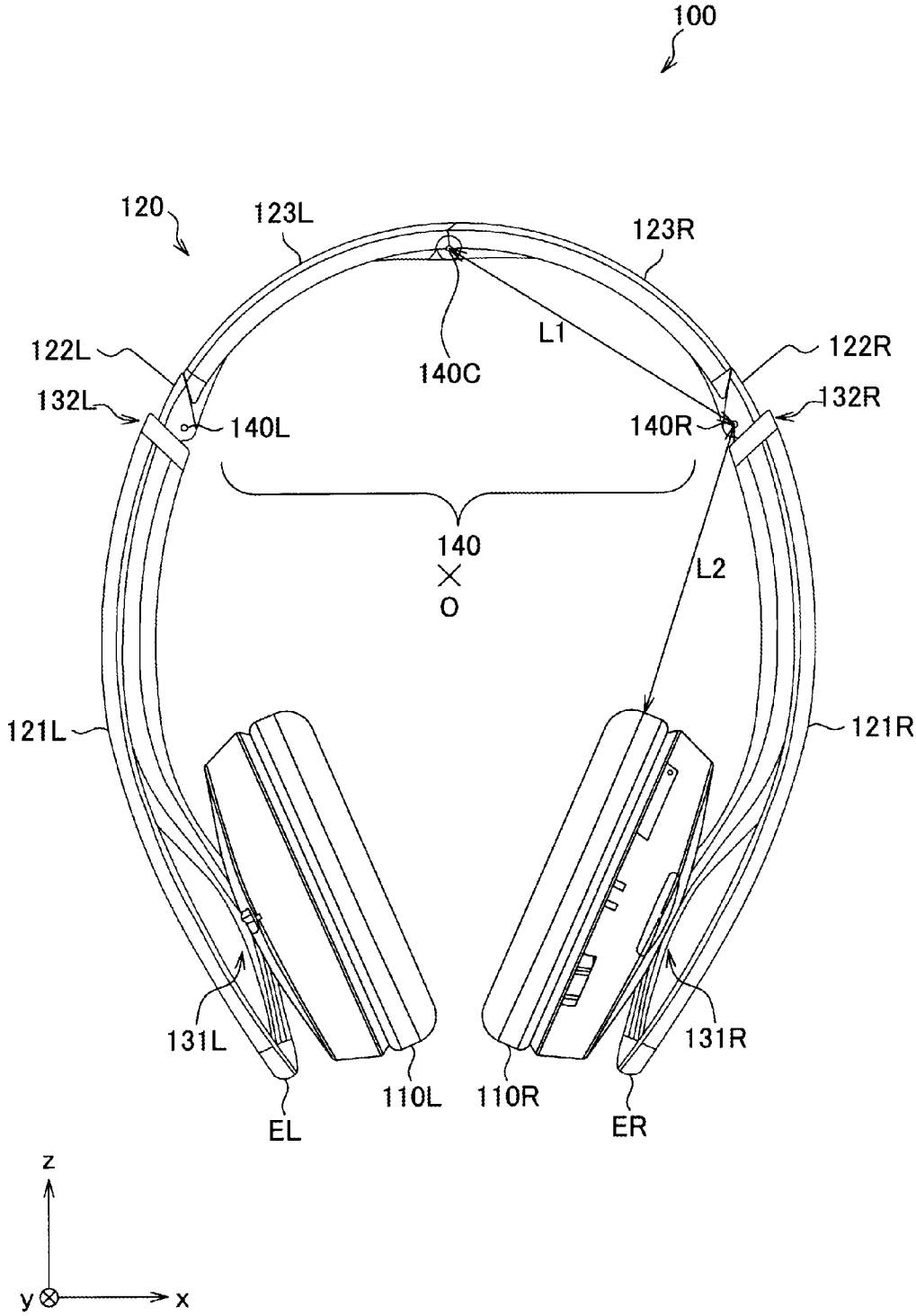
FIG. 1A is an illustration diagram for illustrating a configuration of headphones according to a first embodiment of the present invention before being folded.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

Meanwhile, each embodiment of the present invention may be applied to headphones or earmuffs and the like. However, a basic structure of the earmuffs is identical to that of the headphones except that a member connected to a headband is not a housing accommodating a speaker unit but an ear pad (one example of an earmuff portion). Therefore, hereinafter, it is described by taking the headphones as an example for easier understanding of characteristics and the like of each embodiment of the present invention. However, when the headphones to be described hereinafter are changed to the earmuffs, the earmuff portion for protecting at least a part of (or an entire) ear or keeping the same warm by abutting on the ear of a wearer is connected to the headband, in place of the housing, wiring, an electronic device and the like, for example.

Also, as the headphones according to each embodiment of the present invention, various types of headphones may be used as long as they have a form to use the headband. For example, the headphones may be not only outer ear headphones (having a form to abut on the ears or cover the ears) but also inner ear headphones. However, hereinafter, it is described by illustrating the outer ear headphones for convenience of the description. Also, although a driving circuit and the like and sound signal acquiring means of the headphones are not especially limited, also for convenience of the description, a case in which the headphones according to each embodiment of the present invention acquire a sound signal by wireless communication is described hereinafter. Meanwhile, an example to change to various types of headphones, earmuffs and the like is appropriately supplementarily described.

The headphones according to each embodiment of the present invention may be folded at three points in particular, and is capable of improving portability and durability thereof. Especially, the headphones have a folding mechanism and the like as one of characteristics and further have another characteristic to be described hereinafter. Hereinafter, it is described in a following order for easier understanding of the headphones.

1. Configuration of Headphones according to First Embodiment
2. Folding Process of Headphones according to First Embodiment
2-1. One Example of Folding Process
2-2. Another Example of Folding Process
3. Example of Effect by Headphones according to First Embodiment

1. Configuration of Headphones According to First Embodiment

Figure 1B:
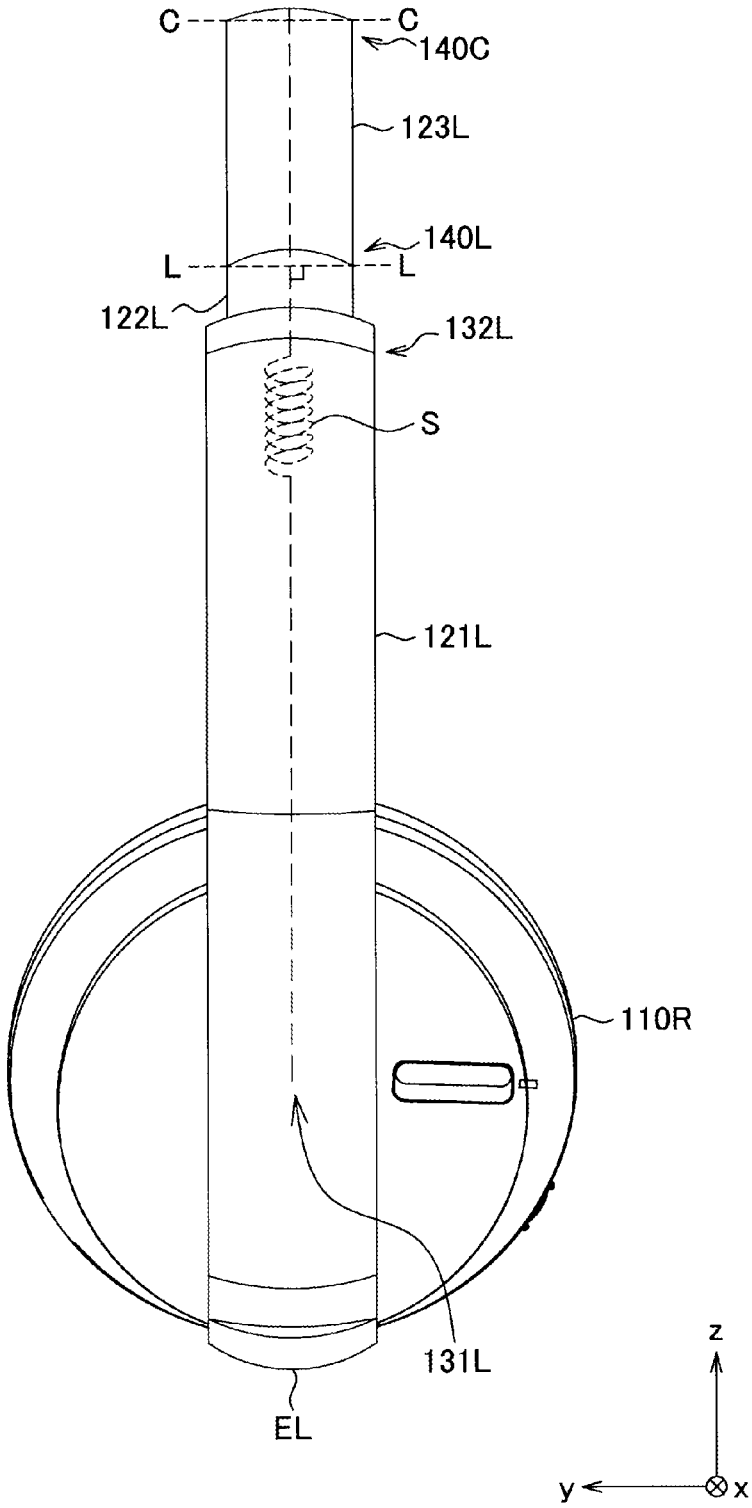
FIG. 1B is an illustration diagram for illustrating the configuration of the headphones according to this embodiment before being folded.
Figure 1C:
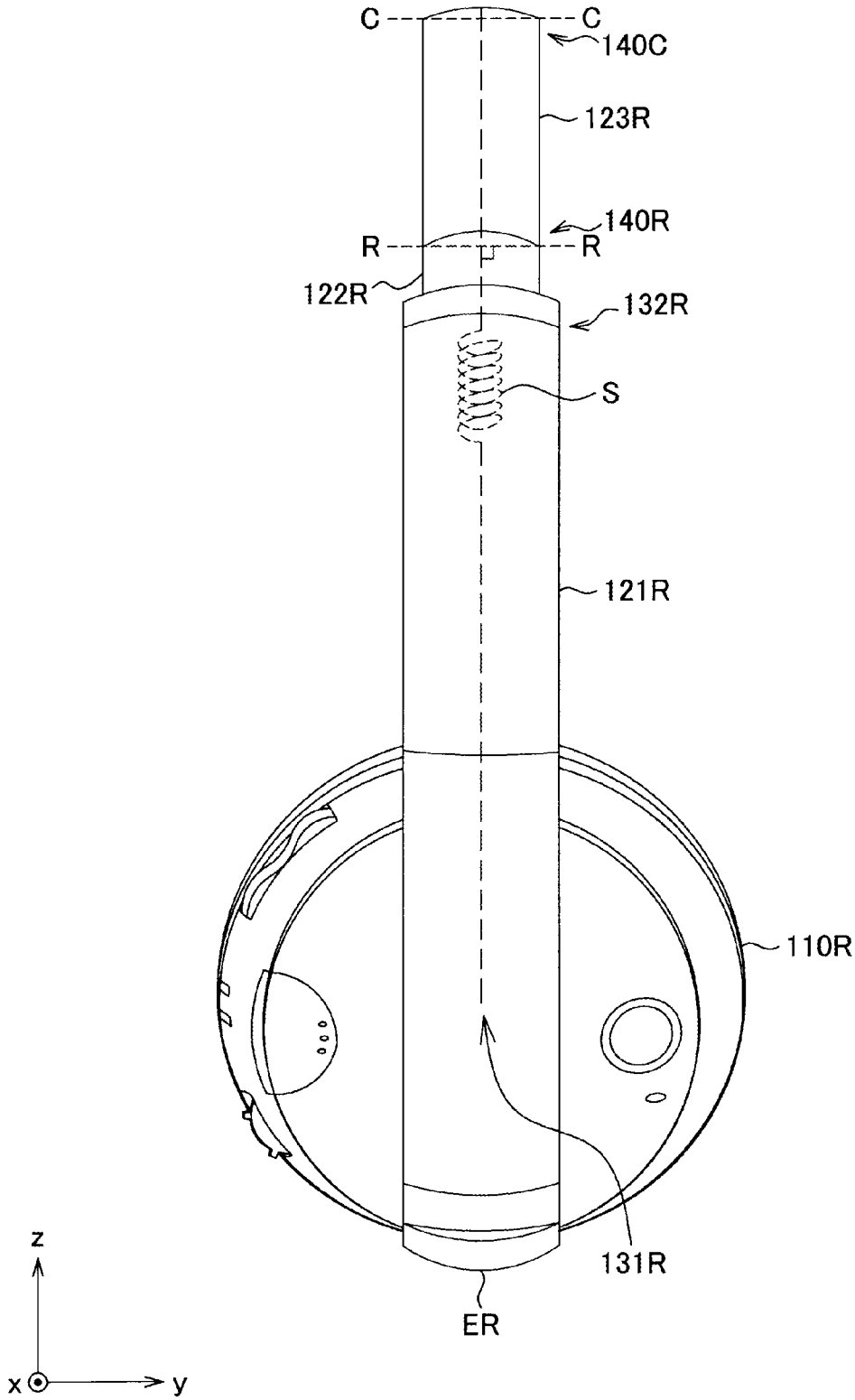
FIG. 1C is an illustration diagram for illustrating the configuration of the headphones according to this embodiment before being folded.

FIGS. 1A to 1C are illustration diagrams for illustrating a configuration of the headphones according to a first embodiment of the present invention before being folded.

As shown in FIG. 1, headphones 100 roughly have housings 110L and 110R, a headband 120, a hinge part 140, connections 131L and 131R, and slide portions 132L and 132R.

The headphones 100 according to this embodiment are over head headphones in which the headband 120 is arranged so as to encircle a top of head of the wearer at the time of wearing, and right and left housings 110R and 110L in each of which the speaker unit and the like for generating a sound is accommodated are connected on tip ends thereof.

Meanwhile, in a following description, a right-hand direction of the wearer at the time of wearing is referred to as "right" and "a positive direction in an x-axis" and a left-hand direction is referred to as "left" and "a negative direction in the x-axis" for easier understanding of the configuration and the like of the headphones 100. Further, a forward direction of the wearer at the time of wearing is referred to as "front" and "a positive direction in a y-axis" and a backward direction is referred to as "back" and "a negative direction in the y-axis". Then, an upward direction of the wearer at the time of wearing is referred to as "above" and "a positive direction in a z-axis" and a downward direction is referred to as "below" and "a negative direction in the z-axis". Meanwhile, the headphones 100 according to this embodiment may be folded at the time of carrying as described above and is capable of dramatically improving portability and durability thereof in a folded state. Although the headphones 100 in the folded state are also described hereinafter, it is hereinafter described supposing that right and left, front and back and above and below thereof after the folding are similar to the above-described right and left, front and back and above and below at the time of wearing before the folding.

Figure 1D:
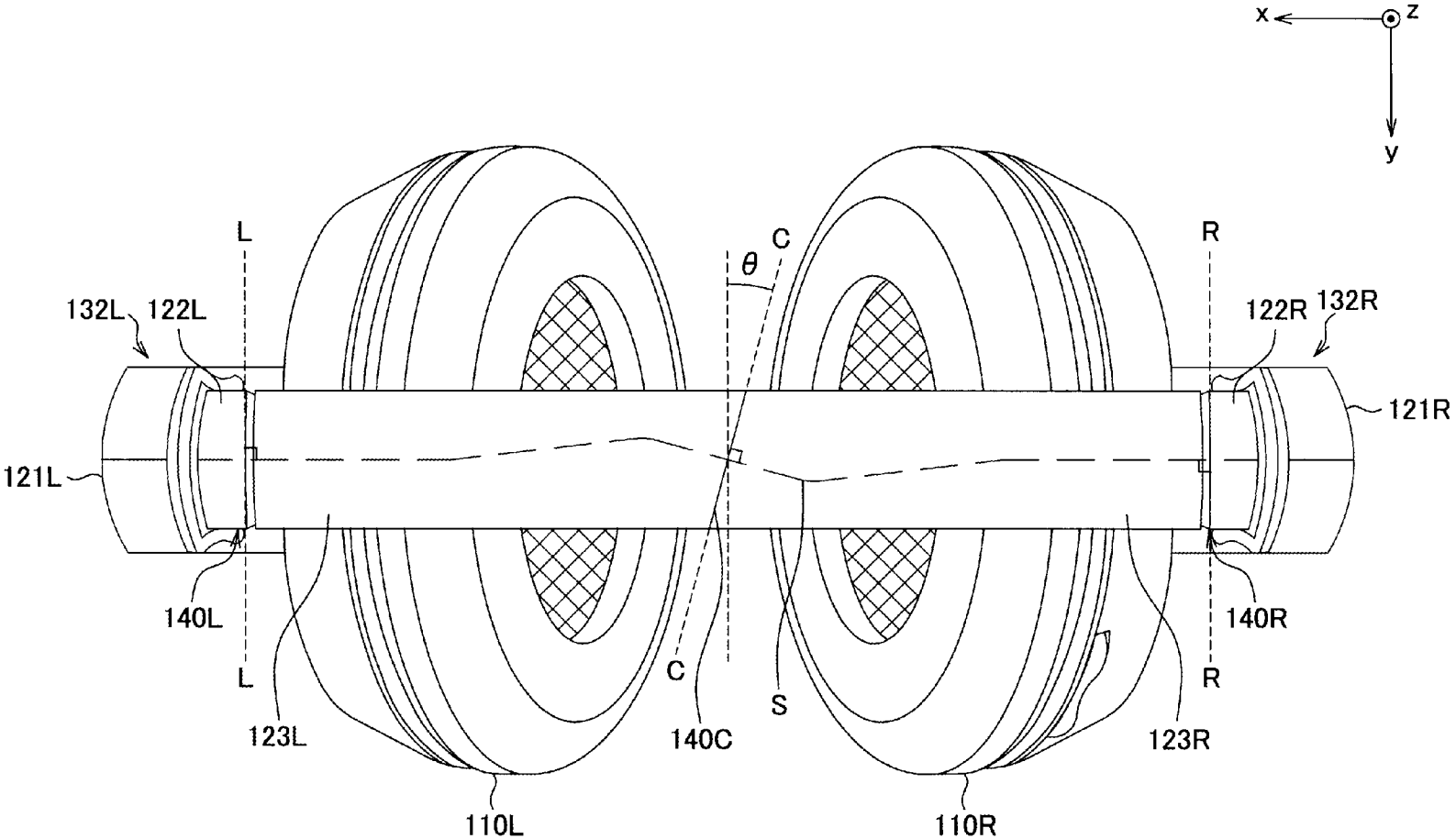
FIG. 1D is an illustration diagram for illustrating the configuration of the headphones according to this embodiment before being folded.
Figure 1E:
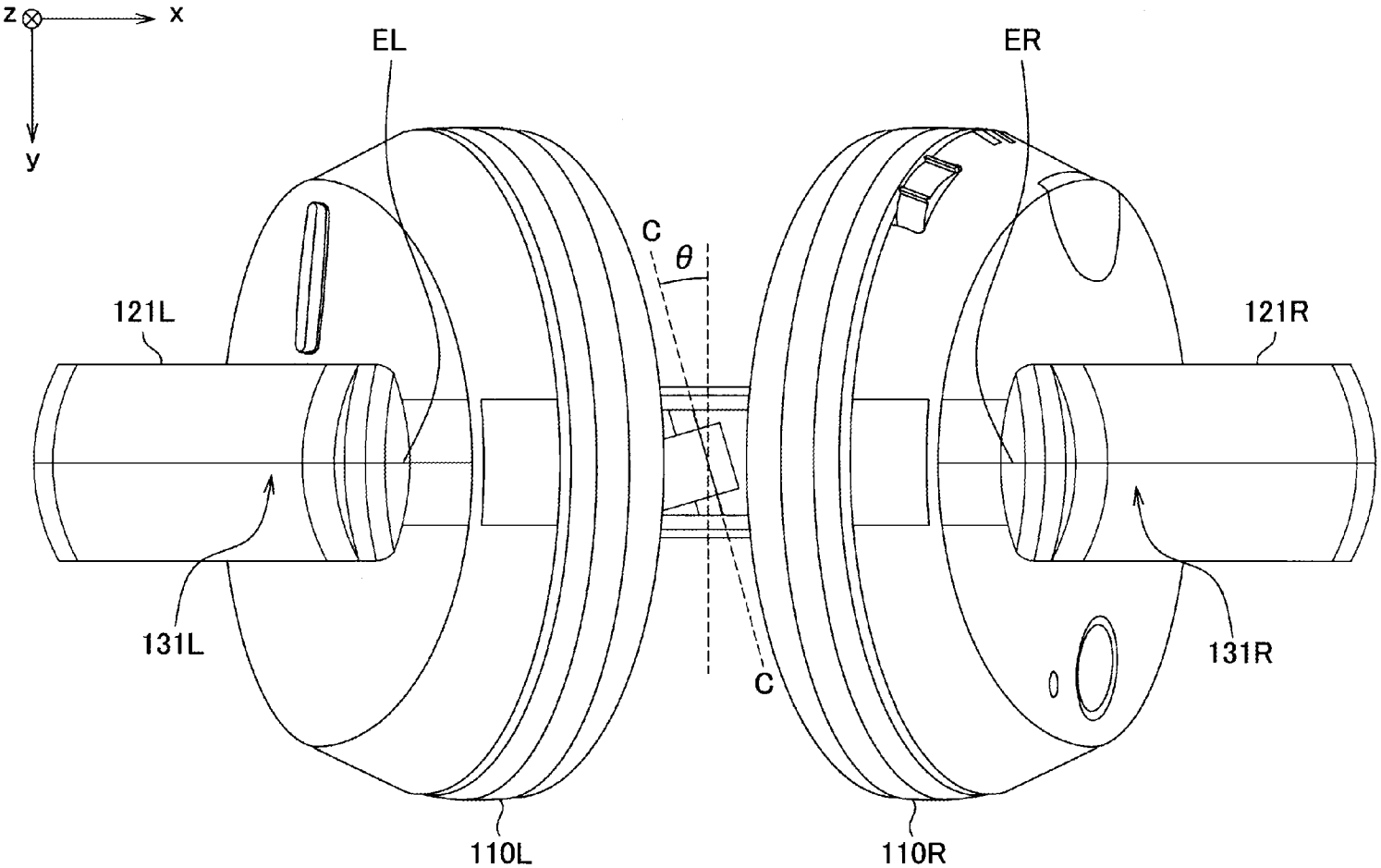
FIG. 1E is an illustration diagram for illustrating the configuration of the headphones according to this embodiment before being folded.

Also, FIG. 1A is a view of the headphones 100 seen from behind the wearer, FIG. 1B is a view of the headphones 100 seen from the left of the wearer, and FIG. 1C is a view of the headphones 100 seen from the right of the wearer. Then, FIG. 1D is a view of the headphones 100 seen from above the wearer and FIG. 1E is a view of the headphones 100 seen from below the wearer.

The housings 110L and 110R cover or abut on a left ear and a right ear of the wearer, respectively, at the time of wearing to provide the sound to the ears of the wearer. For this, the driving circuit including at least the speaker unit for generating the sound is accommodated in each of the housings 110L and 110R. Meanwhile, the housing 110L accommodates the driving circuit for the left ear of the wearer and the housing 110R accommodates the driving circuit for the right ear of the wearer, respectively. That is to say, the right and left housings 110R and 110L are distinguished from each other and form a pair. Meanwhile, such distinction between the housings for the right ear and the left ear is not necessarily made as in a case of the earmuffs in another application example, for example. However, in a case of the headphones 100 for providing a high-quality sound, it is desirable that such distinction is made.

Herein, the driving circuit (including at least the speaker unit) accommodated in the housings 110L and 110R is simply described. As described above, the headphones 100 acquire the sound signal by the wireless communication and change the sound signal to an actual sound to provide to the wearer. That is to say, wireless headphones 100 are herein illustrated. Therefore, as the driving circuit, a receiving circuit for receiving the wirelessly transmitted sound signal is arranged in at least one of the housings 110L and 110R. In a case in which the receiving circuit is arranged in at least one of the housings 110L and 110R, a signal line S for transmitting the sound signal to the other housing is arranged outside the headphones 100 or in the headband 120 of the headphones 110. Meanwhile, in FIG. 1D and the like, a case in which the signal line S is arranged in the headband 120 is illustrated, and the signal line S is indicated by a broken line for convenience. Meanwhile, in a case of wired headphones 100, the signal line S may be directly drawn from both housings 110L and 110R. In this case, it is also possible to draw the signal line S from any one of the housings 110L and 110R to connect the both housings 110L and 110R by another signal line S as in the above description.

A configuration to allow the speaker unit to play the sound signal received by the receiving circuit is accommodated in at least one of the housings 110L and 110R. Although such configuration is not especially limited, there are a power supply mechanism, a demodulating mechanism, a noise canceling mechanism, a volume adjusting mechanism and the like, for example. The power supply mechanism supplies power to the driving circuits arranged in the housings 110L and 110R. It is desirable that the power supply mechanism is formed so as to be able to switch on and off the power supply. On the other hand, the sound signal received by the receiving circuit is often modulated or encoded for the wireless communication. Then, the demodulating mechanism demodulates or decodes such sound signal. Meanwhile, when the sound signal received by the receiving circuit is a digital signal, the demodulating mechanism has a digital/analog conversion circuit. In the sound signal demodulated by the demodulating mechanism, a sound outside the headphones 100 is cancelled by the noise canceling mechanism, so that a noise is reduced. It is desirable that the noise canceling mechanism has a sound collecting microphone for collecting an external sound, a signal generating circuit for generating a signal to cancel a collected noise and a superimposing circuit for superimposing a canceling signal on the sound signal to cancel the noise. The sound signal of which noise is canceled is amplified by the volume adjusting mechanism having an amplifier and the like for converting to a volume desired by the wearer and is supplied to the speaker unit. Then, the speaker unit converts the sound signal to which such a signal process is applied to the actual sound. Meanwhile, although a case in which not only the wireless communication is performed but also a noise canceling process and a volume adjusting process are applied in this manner is herein described, it goes without saying that it is not necessary that such configuration is arranged.

Further, the housings 110L and 110R have through-holes formed in directions of the head of the wearer, that is to say, in a direction of opposite housings 110L and 110R, respectively, as shown in FIG. 1D for providing the sound generated from the speaker unit accommodated in the same to the ears of the wearer. It is desirable that the through-hole is covered with a mesh-like covering member such that the configuration within the same is not exposed to outside. Also, it is desirable that the ear pad enclosing the above-described through-hole and formed of an elastic material is arranged, for example, on a site of each of the housings 110L and 110R abutting on the head of the wearer, as shown in FIG. 1D. The ear pad serves as a buffer member to prevent hard members of the housings 110L and 110R from contacting the head and the ears of the wearer, and is capable of improving a sense of wearing the headphones 110. Meanwhile, it is desirable that the ear pad is formed of a cushion portion having elasticity such as urethane foam and a cover portion covering the cushion portion, for example.

The headband 120 has a shape curved in a longitudinal direction (direction in which the headband is formed in an elongated fashion) thereof, as shown in FIG. 1A, and the housings 110L and 110R are connected to both sides thereof in the longitudinal direction, respectively (one housing to one side). That is to say, the headband 120 is formed to have a substantially arc shape in an xz plane so as to encircle the top of the head of the wearer to connect between both ears (actually, the housings 110L and 110R) as shown in FIG. 1A. Then, the headband 120 connects between the both housings 110L and 110R. In other words, since the headband 120 curves, a center O extending in the y-axis direction being the forward and backward direction (inner side direction of curvature, direction toward the center O in FIG. 1A) is enclosed by the headband 120. Meanwhile, the term "inner side" in the headphones 100 means the direction toward the center O, and an area enclosed by the headband 120 shown in FIG. 1A is an "inner portion" of the headphones 100.

The headband 120 abuts on the top of the head according to a wearing state. Therefore, entire headphones 100 are supported by the top of the head and at least one of frictional forces of the housings 110L and 110R pressed against the head or the ears of the wearer by an elastic force of the headband 120, and a wearing state to the head of the wearer is maintained.

Meanwhile, it is added that the longitudinal direction herein used does not mean a straight line because this is curved in the substantially arc shape enclosing the top of the head as described above. Hereinafter, a direction in which the headband 120 is formed in the elongated fashion, that is to say, a direction along the substantially arc shape enclosing the top of the head is referred to as the "longitudinal direction".

The headband 120 is formed of a material having flexibility capable of being twisted at least about the longitudinal direction. That is to say, the headband 120 may be twisted about the longitudinal direction as a rotational axis. The material having the flexibility includes a plastic material and a material such as rubber, for example. By forming the headband 120 of the material having the flexibility in this manner, the headband 120 may be bent by an external force applied by the wearer and the like so as to enlarge a space between the housings 110L and 110R. Therefore, the wearer holds the both housings 110L and 110R or both ends of the headband 120 and applies the external force to open the both to enlarge the space between the housings 110L and 110R. Thereafter, the wearer wears the headphones 100. The headband 120 of the headphones 100 after being worn tend to change its shape in a direction to narrow the space between the housings 110L and 110R for restoring the shape shown in FIG. 1A, so that the both housings 110L and 110R are pressed against the head or the ears and the like of the wearer. Also, by using such material having the flexibility, it becomes possible to fold the headband 120 such that the housings 110L and 110R do not contact each other when folding the headphones 100 for carrying and the like.

Meanwhile, the headband 120 is formed to have at least three joints (hinge part 140) so as to be foldable. Further, the headband 120 is formed such that lengths of right and left sides may be adjusted (slide portions 132L and 132R). For this purpose, the headband 120 is roughly divided into six members and has a configuration in which the six members are connected to one another. The members composing the headband 120 are set as band components 121L, 122L, 123L, 123R, 122R and 121R in the longitudinal direction from the left housing 110L toward the right housing 110R. Meanwhile, as described above, each of the band components 121L, 122L, 123L, 123R, 122R and 121R has a shape along the longitudinal direction. Also, adjacent band components 121L, 122L, 123L, 123R, 122R and 121R are connected by the hinge part 140 and the slide portions 132L and 132R. Then, the band components 121L, 122L, 123L, 123R, 122R and 121R are formed so as to be symmetrical across a first hinge 140C on the top of the head. The band components 121L, 122L, 123L, 123R, 122R and 121R are described in the hinge part 140 and the slide portions 132L and 132R and the like for connecting them.

However, before describing the hinge part 140 and the slide portions 132L and 132R and the like, the connections 131L and 131R being mechanisms to connect the headband 120 and the housings 110L and 110R are described.

The connections 131L and 131R are arranged on both sides of the headband 120 in the longitudinal direction, respectively, to connect the headband 120 and the housings 110L and 110R. Although arrangement positions of the connections 131L and 131R may be ends of the headband 120, it is desirable that they are arranged on positions in the vicinity of the both ends of the headband 120 in the longitudinal direction as shown in FIG. 1A. However, the connections 131L and 131R are arranged on the band components 121L and 121R (also referred to as "hangers") positioned on the ends in the longitudinal direction out of the components composing the headband 120.

Then, the connections 131L and 131R support the housings 110L and 110R so as to be tiltable relative to the headband 120. At that time, it is not necessary that the connections 131L and 131R invert (rotate 180 degrees) the housings 110L and 110R from a state in which planes generating the sound face the inner side shown in FIG. 1A to a state in which they face an outer side. A tiltable range is desirably an angle with which the planes generating the sound directly oppose to the head and the ears of the user who wears the same, for example. Although it is desirable that one example of the angle is approximately 15 degrees in front and back and in right and left, it goes without saying that this is not limited to this example. Also, it is desirable that a tiltable direction is a direction with at least an upper and lower direction and a right and left direction as axes of tilt. That is to say, it is desired that the connections 131L and 131R support the housings 110L and 110R, respectively, so as to be tiltable relative to the headband 120 with at least the upper and lower direction and the right and left direction as the axes of tilt. As a specific configuration of such tiltable connections 131L and 131R, there is a configuration in which two hinges are connected with a direction parallel to the longitudinal direction of the headband 120 and the y-axis direction as the axes of tilt, for example. Also, as another configuration, a so-called ball bearing connection member may be used, for example. When using the ball bearing connection member, as the connections 131L and 131R, an axial portion, which protrudes in the inner side direction, and in which a substantially spherical end is formed on an end thereof is arranged on any one of the housings 110R and 110L and the band components 121L and 121R. On the other hand, a concave portion to wrap around the spherical shape on the end is formed on a position corresponding to the end of the other of the housings 110R and 110L and the band components 121L and 121R. Then, the housings 110L and 110R are connected to the headband 120 by insertion of the spherical end to the concave portion. On the other hand, an opening of the concave portion is formed so as to be larger than a diameter of the axial portion, and the housings 110L and 110R in which the concave portion or the axial portion is formed tilt by rotation of the spherical end of the axial portion in the concave portion.

In this manner, the connections 131L and 131R allow the housings 110L and 110R to tilt relative to the headband 120, so that when the headphones 110 are folded, the planes generating the sound of the housings 110L and 110R oppose to each other. Therefore, the through-holes and the ear pads of the housings 110L and 110R oppose to each other and are not exposed to the outside or face the outside in a state in which the headphones 110 are folded, so that the durability of the inner driving circuits and the ear pads may be improved. Meanwhile, the housings 110L and 110R in the folded state are described later in detail.

The slide portions 132L and 132R are one example of expanding and contracting portions for connecting between the band components 121L and 122L or the band components 121R and 122R, respectively. The slide portions 132L and 132R may allow the headband 120 to expand and contract in the longitudinal direction.

The configuration of the slide portions 132L and 132R is described more specifically.

In this embodiment, the slide portions 132L and 132R are formed by providing slide holes in the longitudinal direction of the headband 120 from upper ends of the band components 121L and 121R and inserting the band components 122L and 122R to the slide holes. Meanwhile, it goes without saying that the slide holes may be provided on the band components 122L and 122R and the band components 121L and 121R may be inserted to the slide holes in an opposite manner. The length in the longitudinal direction of the headband 120 is expanded and contracted by expanding and contracting insertion lengths of the band components 122L and 122R to the slide holes.

Also, it is desirable that a latch mechanism is formed in the slide portions 132L and 132R such that inserting/extracting motion of the band components 122L and 122R to/from the slide holes and adjustment of an insertion distance become easier. Also, it is desirable that engaging members for engaging the band components 122L and 122R with the slide holes when the insertion distance is the minimum are provided on the slide portions 132L and 132R such that the band components 122L and 122R are not disengaged.

In this manner, it becomes possible to adjust the headband 120 to a desired length by having the slide portions 132L and 132R capable of adjusting the length of the headband 120, and it is possible that the headphones 100 fit a size and a shape of the head of the wearer. Also, by expanding and contracting the headband 120, the headband 120 may be folded such that the housings 110L and 110R do not contact each other when folding the headphones 100 (especially when folding the first hinge 140C to be described later) at the time of carrying and the like.

The hinge part 140 is provided on the headband 120 such that the headphones 100 may be folded. In this embodiment, three joints are provided as folding spots of the hinge part 140. Since the number of the joints is at least three or more, the minimum three joints are herein illustrated. Herein, the joints are referred to as a second hinge 140L, the first hinge 140C and a third hinge 140R in the longitudinal direction of the headband 120 from the left housing 110L.

The first to third hinges 140C to 140R are provided on the headband 120 in the longitudinal direction thereof as shown in FIG. 1A. Then, the first to third hinges 140C to 140R fold the headband 120 in the inner side direction of the curvature. That is to say, the first to third hinges 140C to 140R fold the headband 120 toward the center O from the state shown in FIG. 1A and the like. However, it is desirable, that the first to third hinges 140C to 140R may not fold the headband 120 in a direction away from the center O from the state shown in FIG. 1A and the like. This is because, if the headband changes its shape by the external force at the time of wearing, the sense of wearing is lost and the user has difficulty in comprehending a direction of folding at the time of folding.

Hinge axes (also referred to as axes of folding) C, L and R of the first to third hinges 140C to 140R, respectively, are in a direction perpendicular (y direction, also referred to as the "forward and backward direction) to a plane (xz plane) in which the headband 120 curves, or at an angle tilted from the direction. By forming the hinge axes C, L and R in such direction, the headband 120 may be folded to the inner side of the curvature. Meanwhile, regarding the directions of the hinge axes C, L and R, in other words, the hinge axes C, L and R of the first to third hinges 140C to 140R, respectively, are not in the plane in which the headband 120 is curved for folding the headband 120 in the inner side direction of the curvature. That is to say, the hinge axes C, L and R are not parallel to the longitudinal direction in which the headband 120 is formed in the elongated fashion. The directions of the hinge axes C, L and R are described in detail in the descriptions of the first to third hinges 140C to 140R.

Before describing the first to third hinges 140C to 140R, positional relationship among the first to third hinges 140C to 140R is described. Meanwhile, the positional relationship to be described hereinafter is that of when the above-described slide portions 132L and 132R are contracted the most and the length of the headband 120 is the shortest.

As shown in FIG. 1A, the first hinge 140C is arranged on a nearly center position of the headband 120 in the longitudinal direction. Meanwhile, herein, "nearly center position (substantially center position)" means that this is not strictly limited to the center position, and there is a production error of the headband 120 and the headband 120 may be asymmetrically expanded and contracted by the slide portions 132L and 132R. Also, when there is not a large effect in the positional relationship between the same and another configuration, the first hinge part 140C may be provided on a position shifted a little from the center position. However, it is desirable not only in design but also in production that the first hinge 140C is arranged on the center portion of the headband 120 in the longitudinal direction in a state in which both slide portions 132L and 132R are fully expanded or fully contracted. On the other hand, the second and third hinges 140L and 140R are arranged on positions closer to the first hinge 140C than to the housings 110L and 110R with the first hinge 140C interposed therebetween in the longitudinal direction of the headband 120. The positions of the second and third hinges 140L and 140R on the headband 120 are set such that the first hinge 140C is positioned in the vicinity of the housings 110L and 110R when the headband 120 is folded by the first to third hinges 140C to 140R. A state in which the first hinge 140C is positioned in the vicinity of the housings 110L and 110R is described in a folding process to be described later (refer to FIG. 4A).

Meanwhile, the headphones 100 are formed so as to be nearly symmetrical with the first hinge 140C on the center. Therefore, the above-described positional relationship is described in more detail based on a specific distance by taking the second hinge 140L as an example. First, a linear distance from the first hinge 140C to the second hinge 140L is set to L1. Then, the linear distance from the second hinge 140L to the housing 110L is set to L2. In this case, since the second hinge 140L is provided so as to be closer to the first hinge 140C, L1<L2 is satisfied. However, it is desirable that a difference between the distances L1 and L2 (L2−L1) is not too large such as a few millimeters for the first hinge 140C to position in the vicinity of the housing 110L at the time of folding. The difference is extremely smaller than the length of the entire headband 120 (for example, approximately 270 mm), so that, although the second hinge 140L is positioned so as to be closer to the first hinge 140C, it may be said that L1 and L2 are nearly equal to each other (L1≈L2). However, it is desirable that L1<L2 is satisfied even by a few millimeters. It is desirable that specific numerical values of L1 and L2 are such that L1=64.6 to 68.8 mm and L2=66.0 mm to 70.0 mm (L2>L1), for example.

Next, the first to third hinges 140C to 140R are described together with the hinge axes C, L and R, respectively.

The second hinge 140L connects the band components 122L and 123L so as to be rotatable. At that time, the hinge axis L of the second hinge 140L is formed in a direction perpendicular to the longitudinal direction of the headband 120 and perpendicular to a direction from the headband 120 toward the center O as shown in FIGS. 1B and 1D. That is to say, the hinge axis L is formed so as to be perpendicular to the plane (xz plane) in which the headband 120 curves. In other words, the hinge axis L is formed in the forward and backward direction (y-axis direction). Then, the second hinge 140L may rotate the band components 122L and 123L such that an angle therebetween in the inner side of the headband 120 becomes smaller than that in the state shown in FIG. 1A.

The third hinge 140R connects the band components 122R and 123R so as to be rotatable. At that time, the hinge axis R of the third hinge 140R is formed in a direction perpendicular to the longitudinal direction of the headband 120 and perpendicular to the direction from the headband 120 toward the center O as shown in FIGS. 1C and 1D. That is to say, the hinge axis R is formed so as to be perpendicular to the plane (xz plane) in which the headband 120 curves. In other words, the hinge axis R is formed in the forward and backward direction (y-axis direction). Then, the third hinge 140R may rotate the band components 122R and 123R such that an angle therebetween in the inner side of the headband 120 becomes smaller than that in the state shown in FIG. 1A.

The first hinge 140C connects the band components 123L and 123R so as to be rotatable. At that time, the hinge axis C of the first hinge 140C is formed in a direction perpendicular to the direction from the headband 120 toward the center O as shown in FIGS. 1B and 1C but in a direction not perpendicular to the longitudinal direction of the headband 120 as shown in FIG. 1D. That is to say, the hinge axis C is formed so as to tilt by a predetermined angle θ in the longitudinal direction of the headband 120 relative to the forward and backward direction (y-axis direction) perpendicular to the plane (xz plane) in which the headband 120 curves as shown in FIG. 1D. The third hinge 140R may rotate the band components 123L and 123R such that an angle therebetween in the inner side of the headband 120 becomes smaller than that in the state shown in FIG. 1A. However, although the first hinge 140C folds the band components 123L and 123R toward the inner side of the curvature (center O), due to the angle θ, this does not strictly fold the both members on the plane (xz plane) in which the headband 120 curves. By providing such angle θ, it is possible to prevent the both ends EL and ER of the headband 120 in the longitudinal direction from contacting each other when folding the headband 120 only by the first hinge 140C. That is to say, the both ends EL and ER do not physically contact each other also when the headband 120 is folded only by the first hinge 140C.

Meanwhile, although it is desirable that the angle θ is set to approximately 15 degrees, this may be set to an angle with certain allowance from 15 degrees (for example, 10 to 20 degrees). Meanwhile, when the angle θ is too much smaller than 15 degrees (for example, when this is smaller than 10 degrees), the both ends EL and ER of the headband 120 in the longitudinal direction contact each other when the headband 120 is folded only by the first hinge 140C. In a case of the outer ear headphones 100 as in this embodiment, it is desirable that the angle θ is approximately 15 degrees such that not only the both ends EL and ER of the headband 120 in the longitudinal direction but also the right and left housings 110R and 110L do not contact each other in the folding process. When the angle θ is too much larger than 15 degrees (for example, when this is larger than 20 degrees), since the second and third hinges 140L and 140R protrude too much from the housings 110L and 110R, respectively, after the folding is completed, a volume of the headphones 100 is not made sufficiently smaller, so that it becomes difficult to sufficiently improve the portability and durability thereof. In this case, positions of the right and left housings 110R and 110L do not conform each other as shown in FIG. 4D and the like to be described later, and shift of the center positions of the both after the folding is completed becomes large. This also prevents the volume of the headphones 100 from being smaller, and this might deteriorate storability.

The signal line S connecting between the housings 110L and 110R is arranged in the headband 120 as shown in FIG. 1D and the like in this embodiment. At that time, as described above, the headband 120 is folded by the hinge part 140, so that it is desirable that the signal line S is arranged at right angles to the hinge axes C, L and R such that an excessive load is not applied to the signal line S at the time of rotation. That is to say, for the hinge axes L and R formed in the forward and backward direction, the signal line S is arranged in the longitudinal direction of the headband 120 as shown in FIGS. 1B and 1C. On the other hand, the hinge axis C has the angle θ as shown in FIG. 1D, so that this might put stress to the signal line S than other hinge axes L and R. Therefore, also for the hinge axis C, as shown in FIG. 1D, the signal line S is arranged so as to intersect with the hinge axis C at right angles. As described above, the headband 120 are expanded and contracted by the slide portions 132L and 132R, the signal line S on positions corresponding to the slide portions 132L and 132R also is wound in a helical fashion so as to be capable of expanding and contracting.

Heretofore, the configuration of the headphones 100 according to the first embodiment of the present invention is described. Next, the folding process of the headphones 100 is described with reference to FIGS. 2A to 3B, and thereafter, the headphones 100 after being folded are described with reference to FIGS. 4A to 4E.

2. Folding Process of Headphones according to First Embodiment

The headphones 100 according to this embodiment are folded by the hinge part 140 as described above. That is to say, since the hinge part 140 has the first to third hinges 140C to 140R, the headband 120 of the headphones 100 is folded with three folds. When folding the headband 120, the first hinge 140C of the headband 120 is first folded. Thereafter, the second and third hinges 140L and 140R are sequentially or simultaneously folded.

When folding the second hinge 140L or the third hinge 140R first, the both housings 110L and 110R or the both ends EL and ER of the headband 120 contact each other, so that it is difficult to fold. On the other hand, as described above, the hinge axis C of the first hinge 140C tilts from the forward and backward direction by the angle θ. Therefore, by folding the first hinge 140C first, it is possible to prevent the both ends EL and ER of the headband 120 from contacting each other (refer to FIGS. 2B and 3B). However, in a case of the outer ear headphones 100 as in this embodiment, the housings 110L and 110R are larger than those of the inner ear headphones and the like. Therefore, there is a case in which the housings 110L and 110R contact each other even when the hinge axis C tilts from the forward and backward direction by the angle θ. In such a case, according to the headphones 100 according to this embodiment, it is possible to fold the first hinge 140C so as to resolve the contact of the housings 110L and 110R. As a method of resolving the contact of the housings 110L and 110R, in this embodiment, there is a case in which the headband 120 is twisted and a case in which the slide portions 132L and 132R are used, for example. The former and the latter are specifically described as one example of the folding process and another example thereof, respectively. Although the contact of the housings 110L and 110R may be resolved not only by selecting any one of one example and another example of the folding process but also by combining the both, herein, one example and another example are separately described.

(2-1. One Example of Folding Process)

Figure 2A:
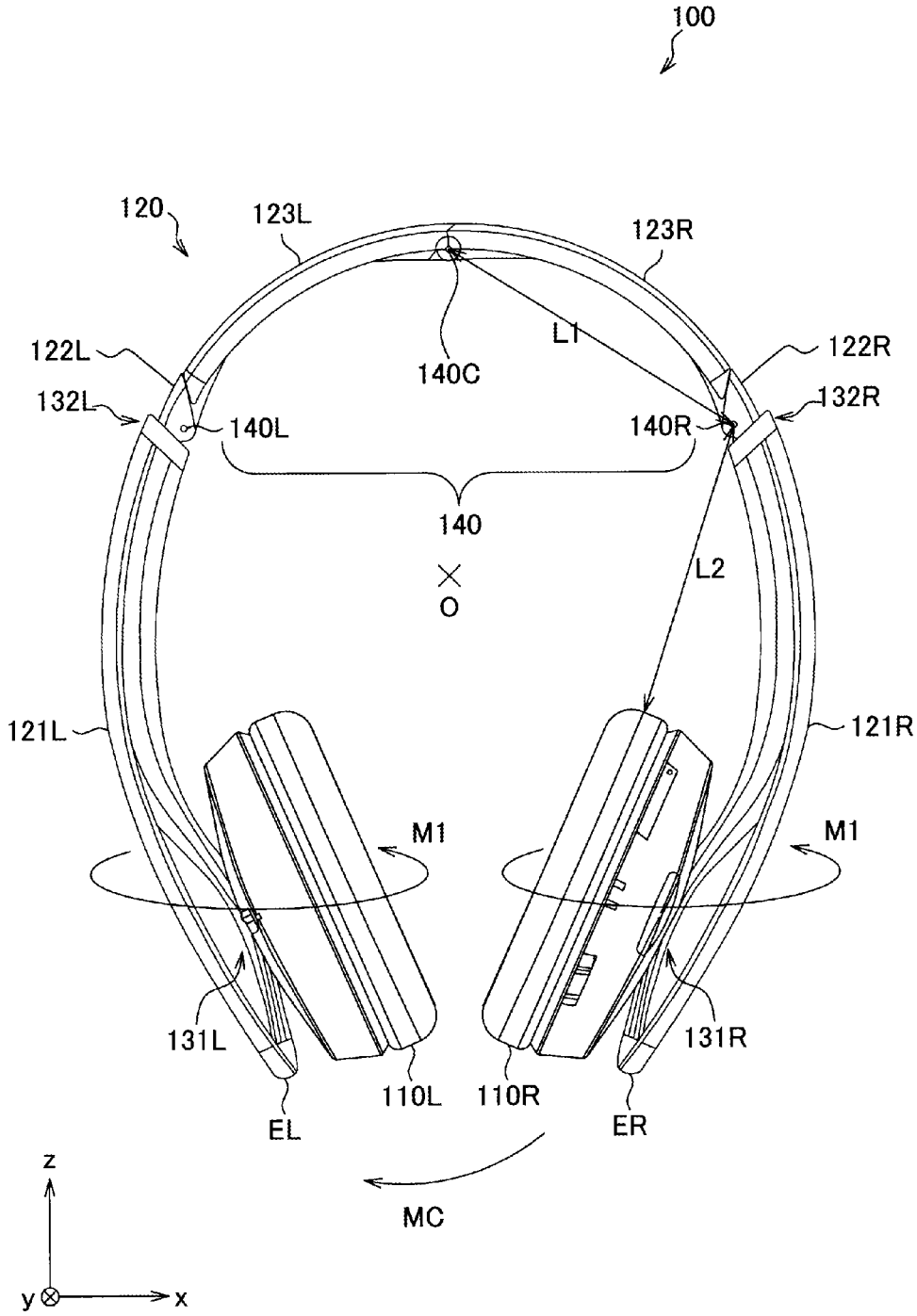
FIG. 2A is an illustration diagram for illustrating one example of a folding process of the headphones according to this embodiment.
Figure 2B:
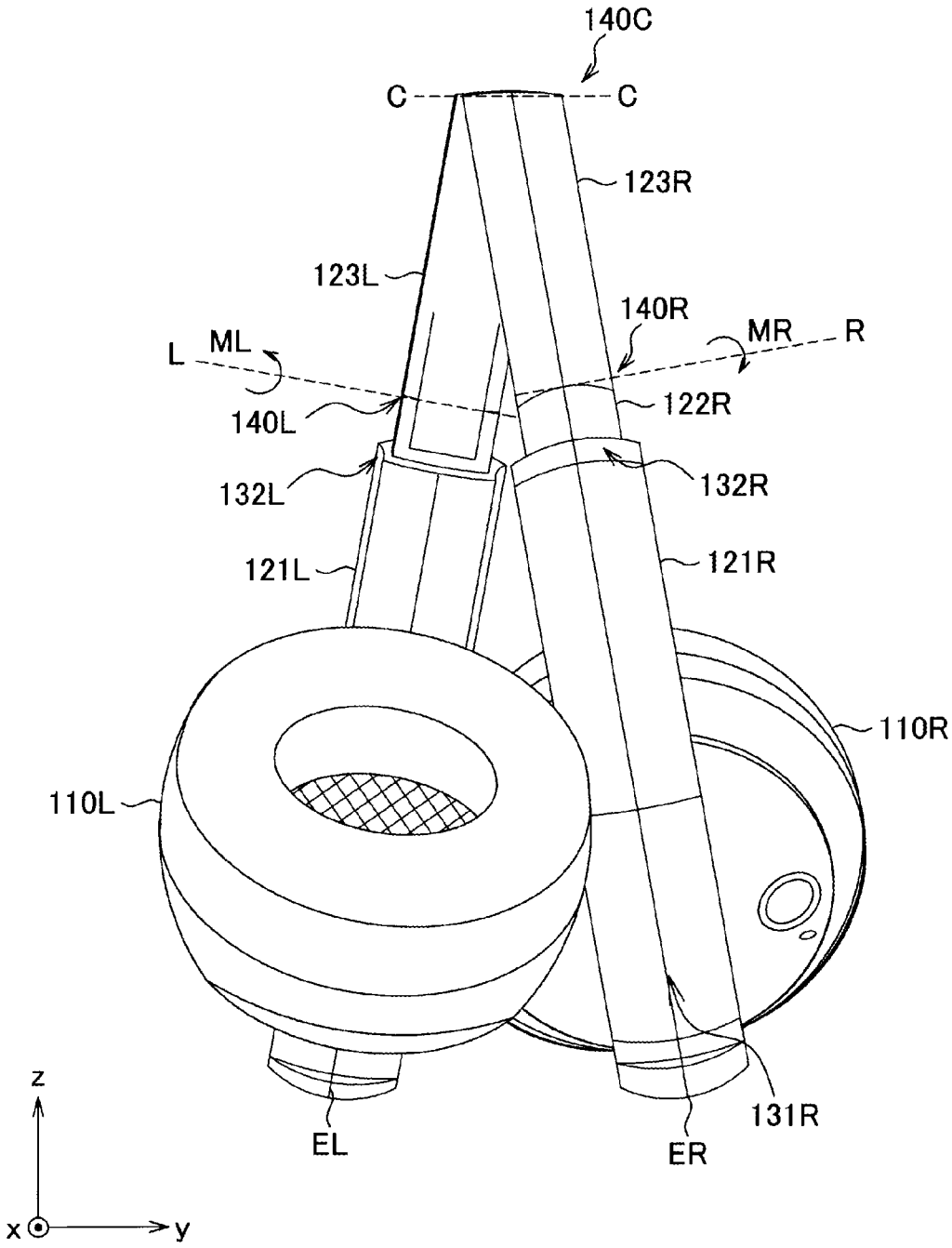
FIG. 2B is an illustration diagram for illustrating one example of a folding process of the headphones according to this embodiment.

First, one example of the folding process is described with reference to FIGS. 2A and 2B. FIGS. 2A and 2B are illustration diagrams for illustrating one example of the folding process of the headphones according to this embodiment.

As described above, the headband 120 is formed of a material having flexibility, which may be twisted at least about the longitudinal direction. Then, in one example of the folding process, when folding the first hinge 140C, the both ends of the headband 120 are twisted as shown in FIG. 2A. In FIG. 2A, one example of a direction of twist is indicated by an arrow M1. As shown in FIG. 2A, when the both ends of the headband 120 (or the housings 110L and 110R) are twisted, the sound generating planes of the housings 110L and 110R face from the inner side direction to forward or backward. As a result, the contact of the housings 110L and 110R is resolved and it becomes possible to rotate the headband 120 about the hinge axis C as indicated by an arrow MC.

Meanwhile, a state in which the headband 120 is folded about the hinge axis C of the first hinge 140C is shown in FIG. 2B. The both ends EL and ER of the headband 120 folded about the hinge axis C offset in the forward and backward direction (y-axis direction) because the hinge axis C tilts, so that they do not contact each other. Also, as described above, the housings 110L and 110R do not contact each other because the headband 120 is twisted when they pass each other. In this manner, after the first hinge 140C is folded, the second and third hinges 140L and 140R are folded, and one example of the folding process is finished.

(2-2. Another Example of Folding Process)

Figure 3A:
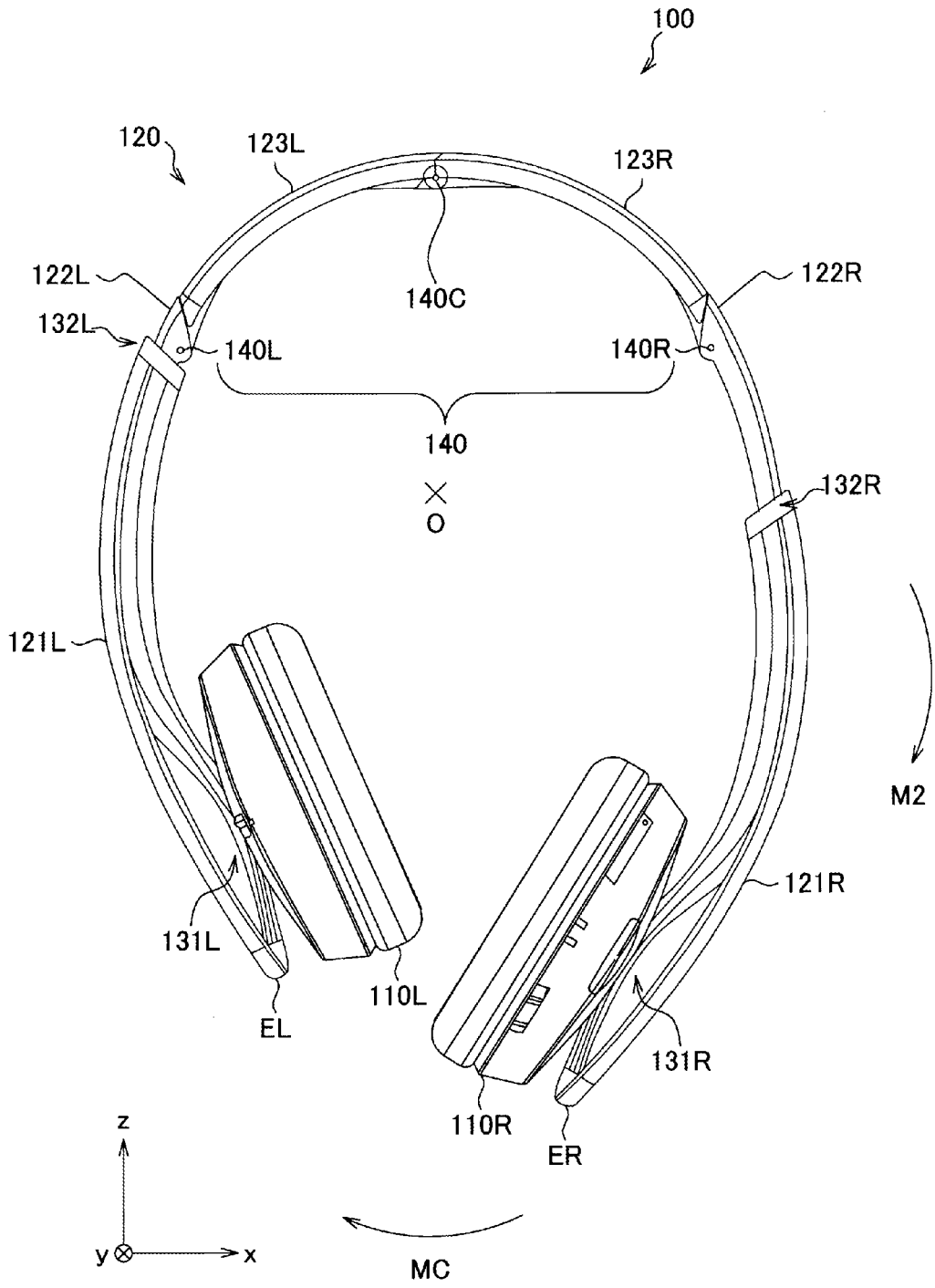
FIG. 3A is an illustration diagram for illustrating another example of the folding process of the headphones according to this embodiment.
Figure 3B:
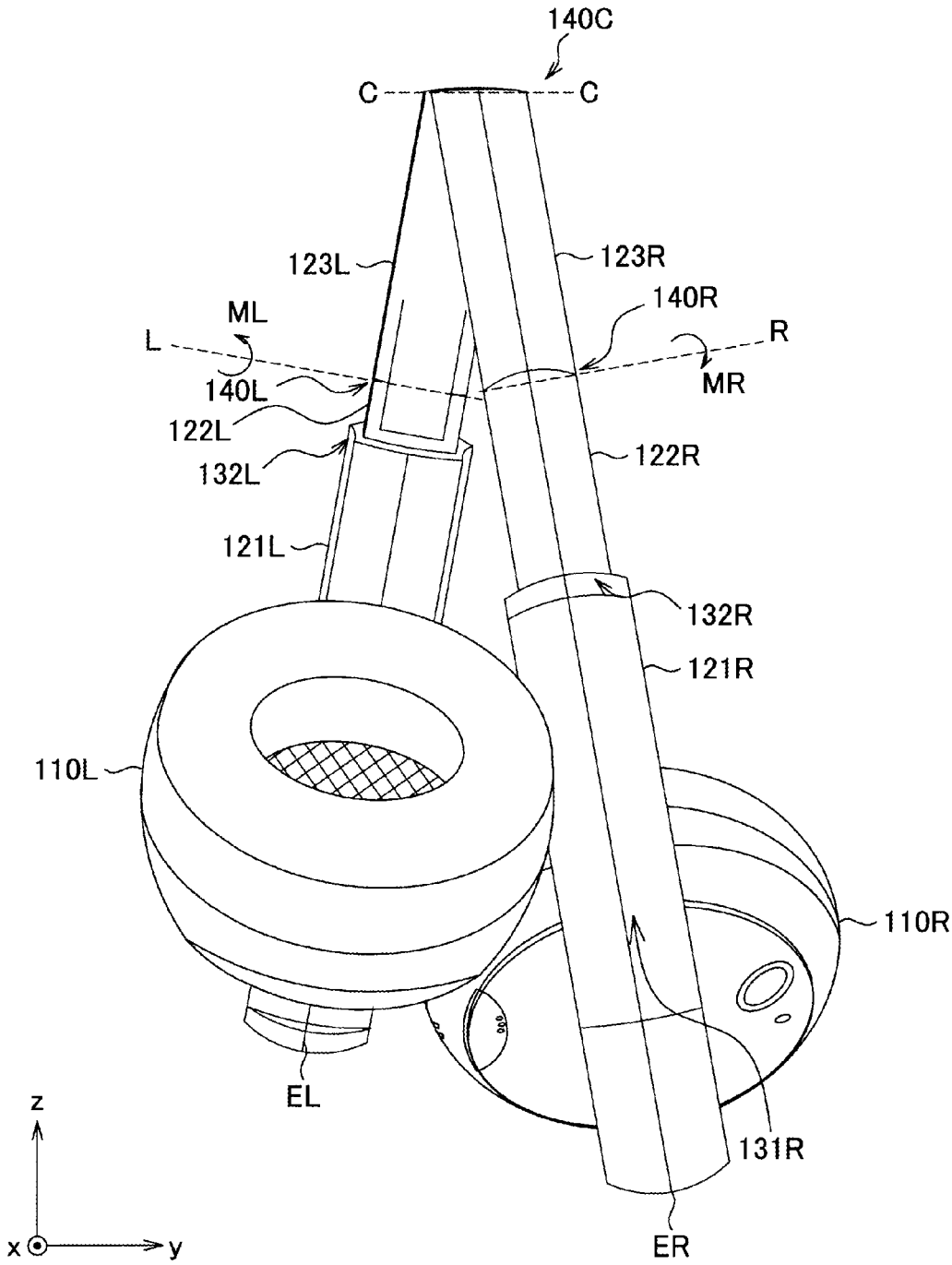
FIG. 3B is an illustration diagram for illustrating another example of the folding process of the headphones according to this embodiment.

Next, another example of the folding process is described with reference to FIGS. 3A and 3B. FIGS. 3A and 3B are illustration diagrams for illustrating another example of the folding process of the headphones according to this embodiment.

As described above, it is possible to separately expand and contract the right and left sides of the headband 120 by the slide portions 132L and 132R with the first hinge 140C as a boundary. Then, in another example of the folding process, when folding the first hinge 140C, as shown in FIG. 3A, one of the right side and the left side of the headband 120 is expanded and the other of them is contracted. In FIG. 3A, a state in which the right side of the headband 120 is expanded by the slide portion 132R as indicated by an arrow M2 is shown. As shown in FIG. 3A, when one of the right side and the left side of the headband 120 is expanded, the housings 110L and 110R offset in the upward and downward direction (z-axis direction). As a result, the contact of the housings 110L and 110R is resolved and it becomes possible to rotate the headband 120 about the hinge axis C as indicated by the arrow MC.

Meanwhile, a state in which the headband 120 is folded about the hinge axis C of the first hinge 140 is shown in FIG. 3B. The both ends EL and ER of the headband 120 folded about the hinge axis C offset in the forward and backward direction (y-axis direction) because the hinge axis C tilts, so that they do not contact each other. Also, as described above, the housings 110L and 110R do not contact each other because they offset in the upward and downward direction when passing each other. In this manner, after the first hinge 140C is folded, the second and third hinges 140L and 140R are folded, and one example of the folding process is finished.

3. Example of Effect by Headphones According to First Embodiment

Next, the configuration of the headphones 100 according to this embodiment after being folded is described by taking an effect of the headphones 100 as an example with reference to FIGS. 4A to 4E.

Figure 4A:
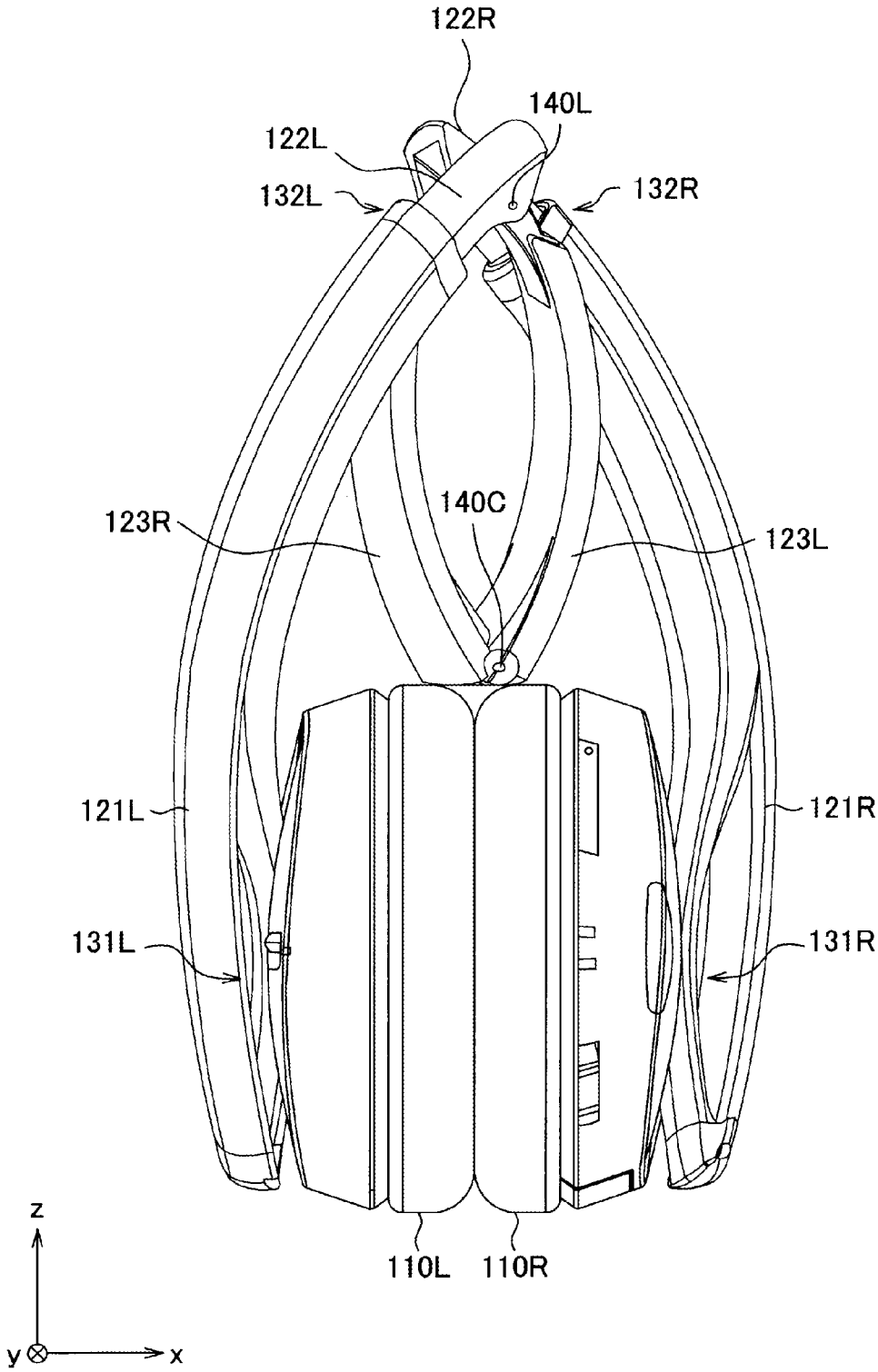
FIG. 4A is an illustration diagram for illustrating the configuration of the headphones according to this embodiment after being folded.
Figure 4B:
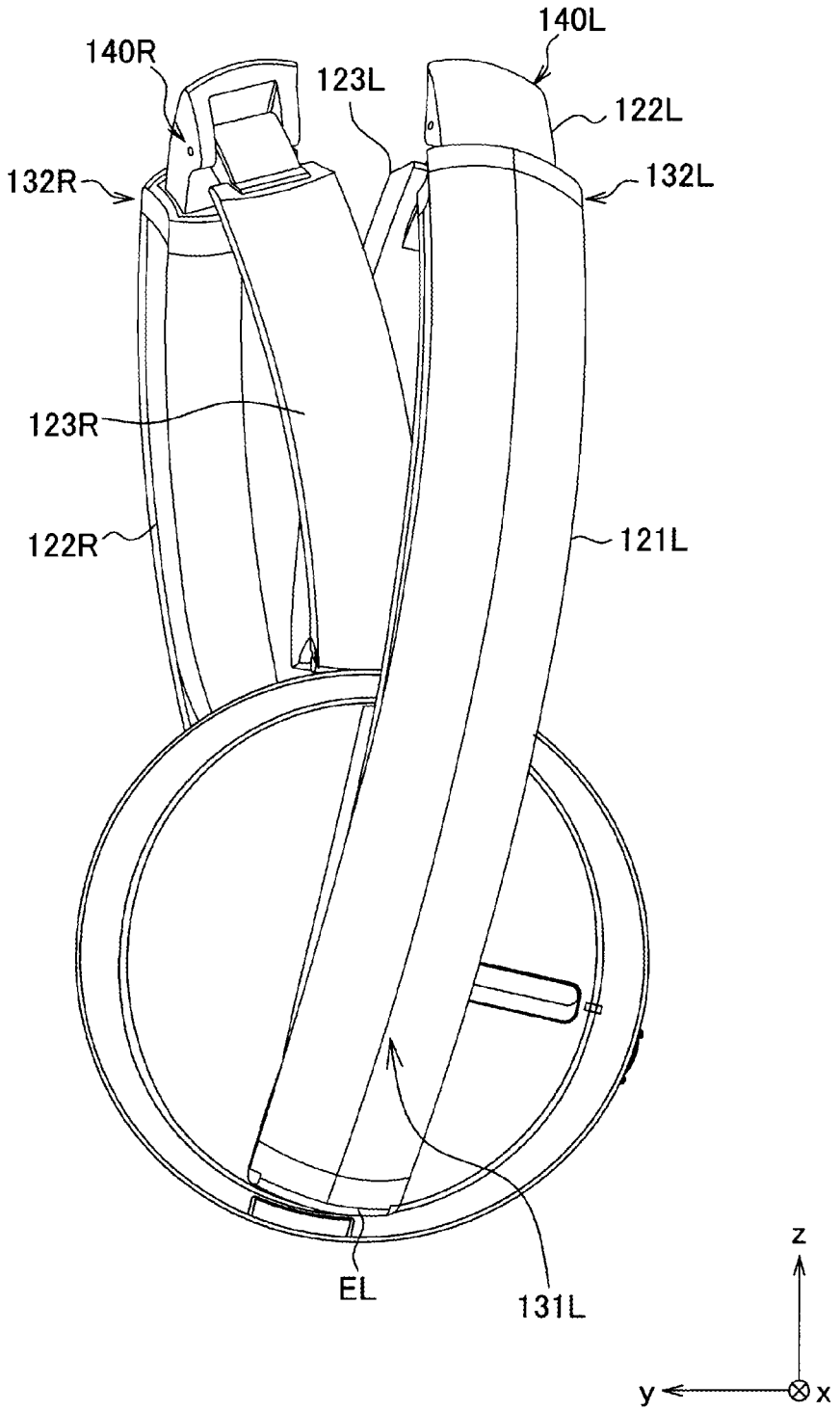
FIG. 4B is an illustration diagram for illustrating the configuration of the headphones according to this embodiment after being folded.
Figure 4C:
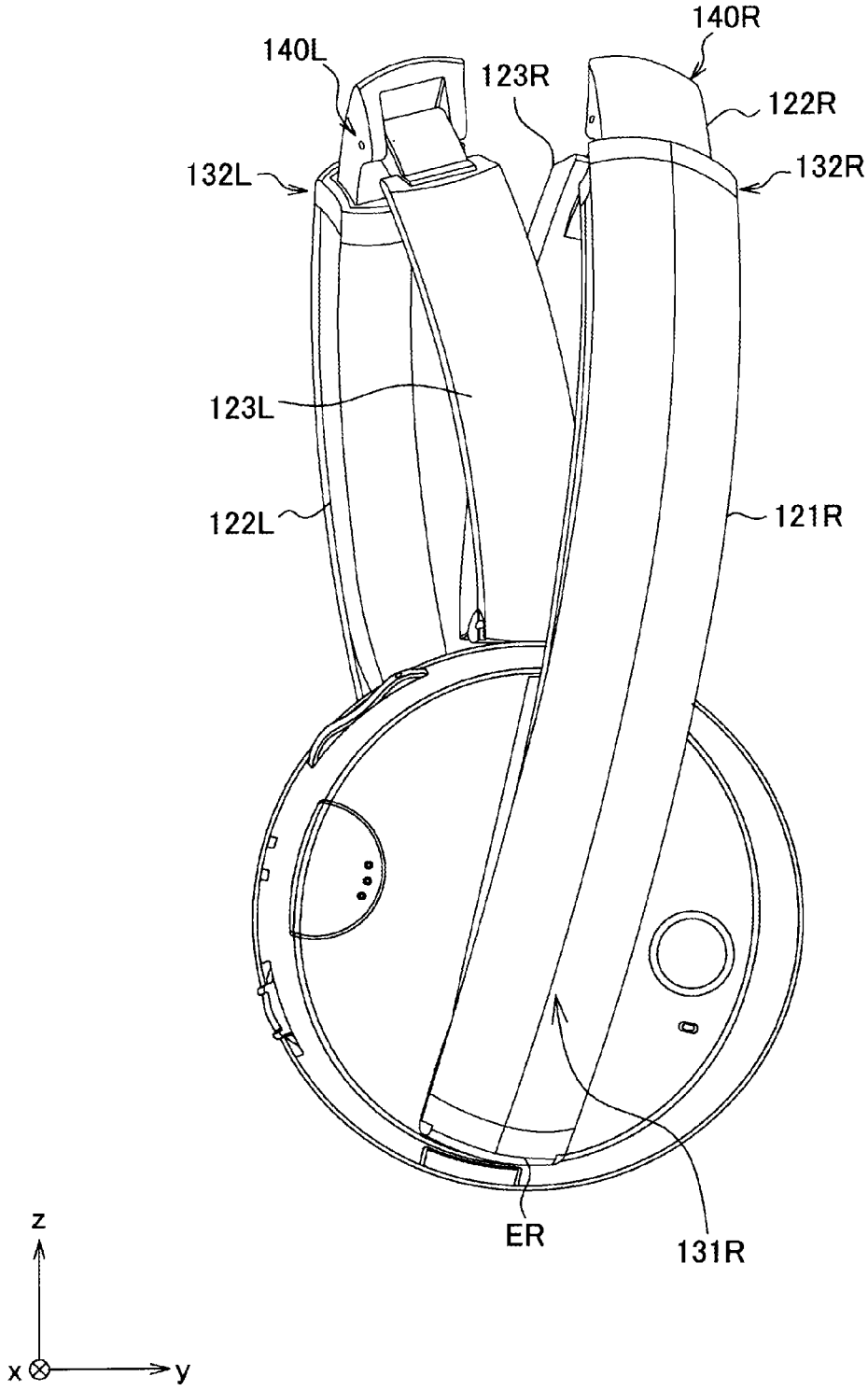
FIG. 4C is an illustration diagram for illustrating the configuration of the headphones according to this embodiment after being folded.
Figure 4D:
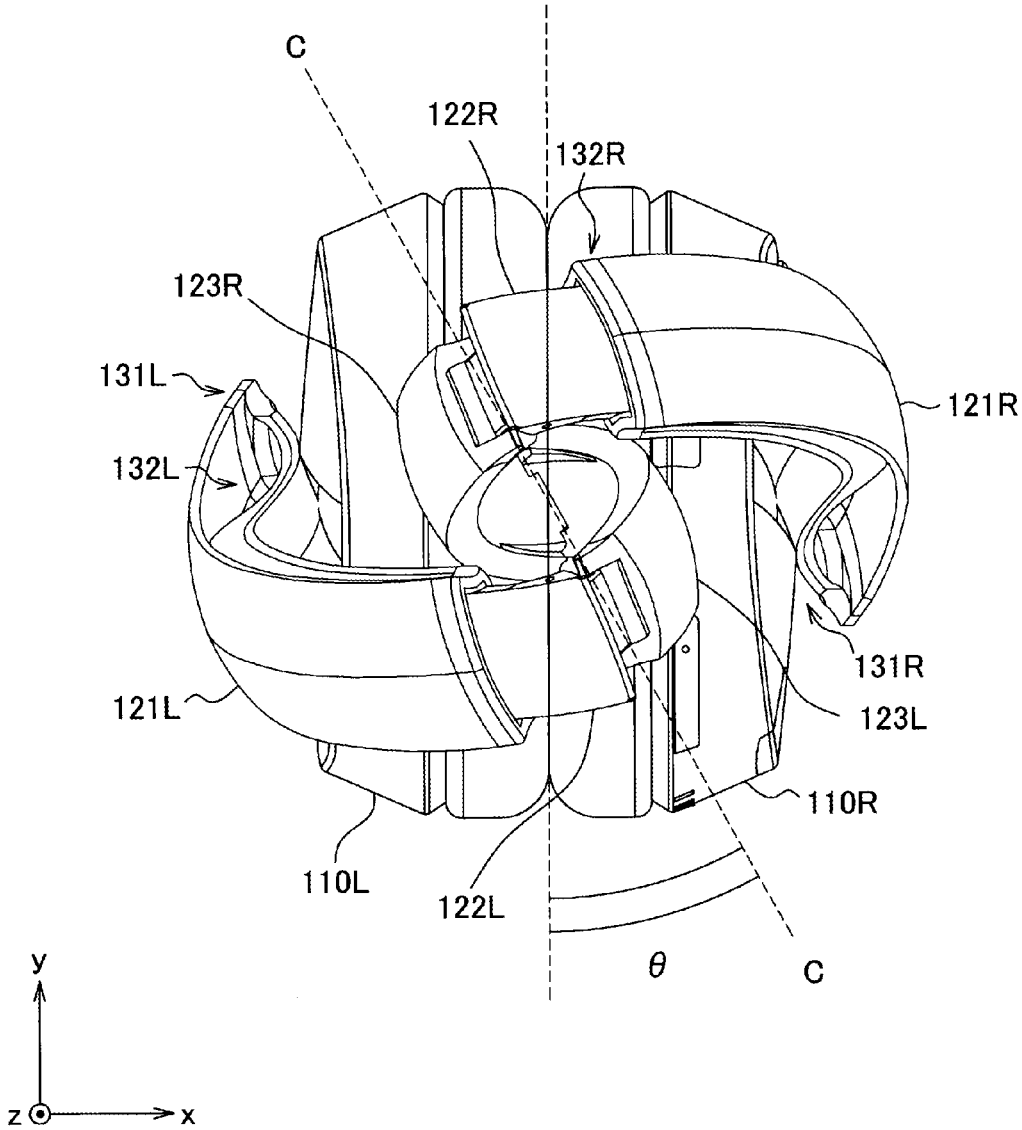
FIG. 4D is an illustration diagram for illustrating the configuration of the headphones according to this embodiment after being folded.
Figure 4E:
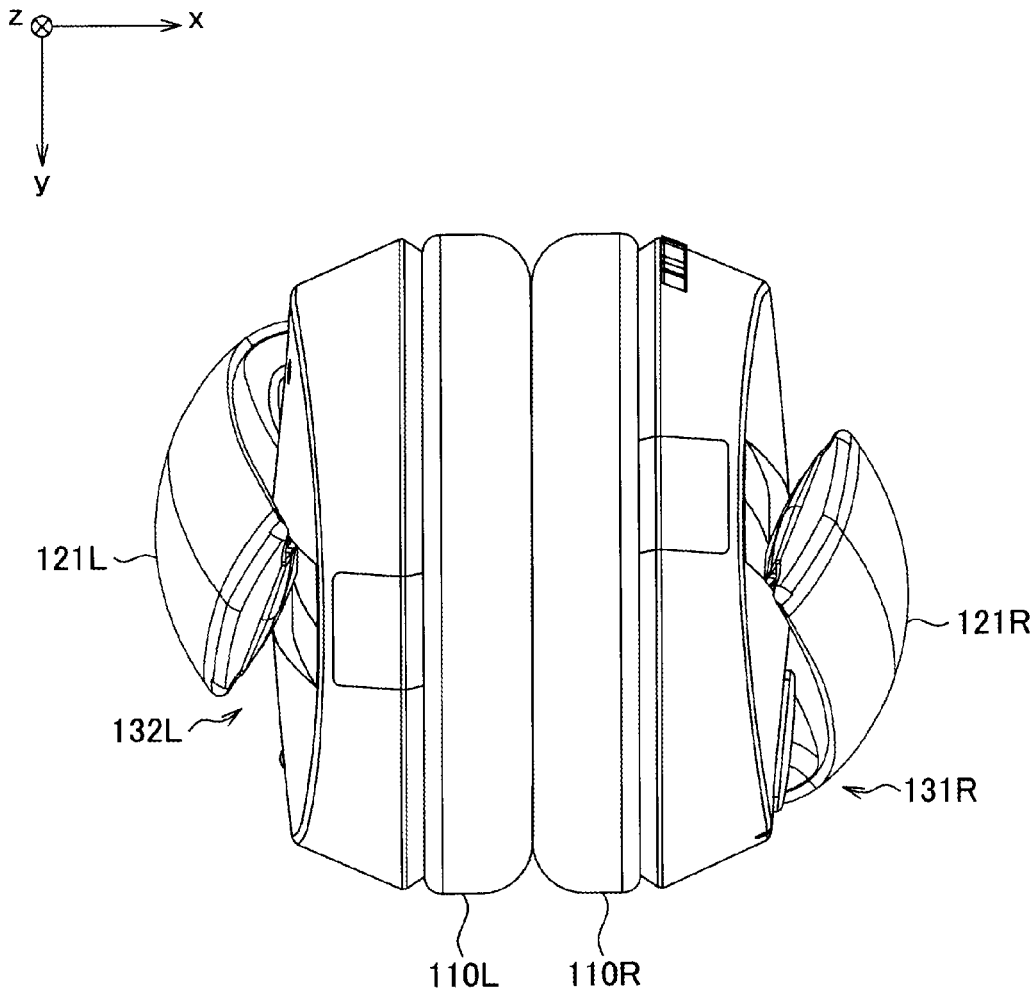
FIG. 4E is an illustration diagram for illustrating the configuration of the headphones according to this embodiment after being folded.

FIGS. 4A to 4E are illustration diagrams for illustrating the configuration of the headphones according to this embodiment after being folded. Meanwhile, FIG. 4A is a view of the headphones 100 seen from behind the wearer, FIG. 4B is a view of the headphones 100 seen from the left side of the wearer, and FIG. 4C is a view of the headphones 100 seen from the right side of the wearer. FIG. 4D is a view of the headphones 100 seen from above the wearer and FIG. 4E is a view of the headphones 100 seen from below the wearer.

Since the positions of the first to third hinges 140C to 140R are set as described above, the first hinge 140C after the folding is positioned in the vicinity above the housings 110L and 110R as shown in FIG. 4A. On the other hand, the second and third hinges 140L and 140R are positioned so as to be arranged in the forward and backward direction (y-axis direction) as shown in FIGS. 4A to 4C. The second and third hinges 140L and 140R do not protrude in the forward and backward direction from the housings 110L and 110R as shown in FIG. 4D. Therefore, the headphones 110 may be folded so as to be compact with extremely high space efficiency to improve the portability thereof, and damage of the hinge part 140 is minimum, so that the durability at the time of accommodation and at the time of carrying may be dramatically improved.

On the other hand, as described above, each of the housings 110L and 110R is connected to the headband 120 so as to be tiltable. Therefore, as shown in FIG. 4E, the housings 110L and 110R are tilted and the sound generating planes thereof face to abut on each other, in the folded state. As a result, the through-holes with which the configurations (such as the speaker units) in the housings 110L and 110R communicate with an external air are covered with the opposing housings 110L and 110R and protected. Therefore, the durability at the time of carrying is further improved, and a further compact size may be realized.

Then, as shown in FIGS. 4A to 4E, in the folded state, each of the band components and the band components and the housings 110L and 110R of the headband 120 do not abut on or contact each other. Especially, the ear pads of the housings 110L and 110R only abut on the ear pads having the same elasticity of the opposing housings 110L and 110R as shown in FIG. 4A. Therefore, the ear pad does not change its shape in the folded state and other components do not break each other, so that the durability at the time of carrying may be dramatically improved. If the ear pad changes its shape, airtightness between the housings 110L and 110R and the ears of the wearer lowers and it becomes difficult to ensure a design sound quality. Such lowering in the airtightness significantly lowers noise canceling performance and is not desirable in a case of the headphones 100 provided with a noise canceling function as in this embodiment. However, as described above, according to the headphones 100 according to this embodiment, such defect may be prevented.

The headphones 100 may be sold in the folded state because this may be made extremely compact when being folded and the housings 110L and 110R, the headband 120 and the like face the outer side in this manner. That is to say, it is necessary that the headphones 100 are displayed so as to allow the user to recognize a design thereof, because there are many users placing importance on an appearance and the like. In order to meet needs of such users, the headphones 100 may be sold in the folded state, because an external design thereof faces the outside even in the folded state. At that time, the headphones 100 are folded so as to be extremely compact, so that it is possible to make a package size compact, thereby reducing transportation costs.

Meanwhile, although there are the headphones folded at three points as related technology of the headphones 100 according to this embodiment, in the headphones according to the related technology, axes of folding positions are parallel, so that there is a limit in an angle of folding. However, the headphones 100 according to this embodiment may be folded so as to be extremely compact as described above, and the portability thereof may be dramatically improved. Also, in the headphones of the related technology, axes of folding (that is to say, the hinge axes) are parallel, so that the angle of folding is small and there is a case in which the folded headband is opened at the time of carrying. However, as shown in FIG. 4A, in a case of the headphones 100 according to this embodiment, the first to third hinges 140C to 140R may fold the headband 120 at an very large angle such that the band components connected by them are nearly parallel to one another. Therefore, the headband 120 is not opened at the time of carrying. Also, the angle of folding is small as described above in the headphones of the related technology, so that there is large limitation of space in design of the entire headphones; however, there is only small limitation in the headphones 100 according to this embodiment, so that this may be composed with various designs. Also, the headphones 100 according to this embodiment may be made extremely compact only by the three hinge axes C, L and R, so that it is not necessary to add another structure such as to increase the number of hinge axes for realizing such portability. Therefore, it is possible to reduce production costs, thereby further improving the durability.

It should be understood by those skilled in the art that various modifications, combinations, sub-combinations and alterations may occur depending on design requirements and other factors insofar as they are within the scope of the appended claims or the equivalents thereof.

For example, a case in which the characteristics and the like of the present invention are applied to the headphones 100 is described in the embodiment. However, as described above, such characteristics may also be applied to the earmuffs having the similar form as that of the headphones 100. When the characteristics and the like of the present invention are realized as the earmuffs, the configuration regarding acoustic equipment is deleted from the configuration of the headphones 100 of the first embodiment. Further, the right and left housings 110R and 110L are changed to the ear pads (one example of the earmuff portions) abutting on at least a part of the ears of the user at the time of wearing and the like. However, another principal configuration, especially the folding mechanism and the like of the headband 120 may be configured so as to be similar to that of the headphones 100 of the first embodiment, the detailed description is herein omitted. Also, it is possible of course to apply them to a head set provided with the microphone as a variation of the headphones.

Also, the outer ear headphones are described as the example of the headphones 100 in the embodiment. However, as described above, various types of headphones may be used as long as they have the form to use the headband 120. In this case, a size, a shape and the like of the housings 110L and 110R and the speaker units accommodated in the same are changed. However, as in the case of the earmuffs, another principal configuration, especially the folding mechanism of the headband 120 and the like may be configured so as to be similar to that of the headphones 100 of the first embodiment, so that a detailed description is herein omitted.

Also, the case in which the headband is folded about the three hinge axes C, L and R, that is to say, by the first to third hinges 140C to 140R is described in the above-described embodiment. However, it is also possible to increase the number of hinges of the headband 120. In this case, the hinge of which hinge axis C tilts as the first hinge 140C and the hinges of which hinge axes L and R do not tilt as the second and third hinges 140L and 140R are alternately arranged in the longitudinal direction. In this case also, the hinge of which hinge axis tilts is arranged on the nearly center position of the headband 120 and the hinges of which hinge axes do not tilt are arranged on the positions the closest to the housings 110L and 110R. As a result, when the number of hinges of which hinge axis tilts is n, the number of hinges of which hinge axis do not tilt is n+2. By increasing the number of joints in this manner, the number of hinges arranged in the forward and backward direction (y-axis direction) shown in FIG. 4A in the folded state is increased, and as a result, the headband 120 is wound in the helical fashion as if the forward and backward direction is the axis thereof.

The present application contains subject matter related to that disclosed in Japanese Priority Patent Application JP 2009-006097 filed in the Japan Patent Office on 14 Jan. 2009, the entire content of which is hereby incorporated by reference.

What is claimed is:

1. A headphone comprising:

a pair of right and left housings each for accommodating a speaker unit;

a headband having a shape curved in a longitudinal direction to which the pair of right and left housings are connected on both sides in the longitudinal direction, respectively; and a first hinge, a second hinge, and a third hinge each provided on the headband so as to be arranged in the longitudinal direction and capable of folding the headband in an inner side direction of curvature;

wherein the first hinge positioned between the second and third hinges is capable of folding the headband about a hinge axis tilted relative to a forward and backward direction perpendicular to the longitudinal direction of the headband such that both ends in the longitudinal direction of the headband folded only by the first hinge do not contact each other.

2. The headphone according to claim 1, wherein the second hinge and the third hinge are capable of folding the headband about hinge axes extending in the forward and backward direction.

3. The headphone according to claim 1, wherein the first hinge is arranged on a substantially center position of the headband in the longitudinal direction, and the second hinge and the third hinge are arranged on positions closer to the first hinge than to the right and left housings with the first hinge interposed therebetween in the longitudinal direction of the headband.

4. The headphone according to claim 3, wherein the positions of the second hinge and the third hinge on the headband are set such that the first hinge is positioned in the vicinity of the right and left housings when the headband is folded by the first hinge, the second hinge and the third hinge.

5. The headphone according to claim 1, wherein the headband is formed of a material having flexibility twistable at least about the longitudinal direction, such that the right and left housings do not contact each other when the first hinge folds the headband.

6. The headphone according to claim 1, wherein an expanding and contracting portion capable of expanding and contracting the headband in the longitudinal direction is provided on at least one spot of the headband, and the expanding and contracting portion expands and contracts the headband such that the right and left housings do not contact each other when the first hinge folds the headband.

7. The headphone according to claim 1, wherein the housings are connected to the headband so as to be tiltable such that planes from which the speaker unit generating a sound oppose to each other when the headband is folded by the first hinge, the second hinge, and the third hinge.

8. The headphone according to claim 1 further comprising:

a signal line arranged in the headband for transmitting a sound signal between driving circuits accommodated in both of the right and left housings;

wherein the signal line is arranged so as to intersect with the hinge axis of the first hinge at right angles.

9. An earmuff comprising:

a pair of right and left earmuff portions for covering ears of a wearer at the time of wearing;

a headband having a shape curved in a longitudinal direction to which the pair of right and left earmuff portions are connected on both sides in the longitudinal direction, respectively; and a first hinge, a second hinge and a third hinge provided on the headband so as to be arranged in the longitudinal direction and capable of folding the headband in an inner side direction of curvature;

wherein the first hinge positioned between the second and third hinges is capable of folding the headband about a hinge axis tilted relative to a forward and backward direction perpendicular to the longitudinal direction of the headband such that both ends in the longitudinal direction of the headband folded only by the first hinge do not contact each other.

* * * * *